US010800643B2

(12) United States Patent
Gatipon et al.

(10) Patent No.: US 10,800,643 B2
(45) Date of Patent: Oct. 13, 2020

(54) BEVERAGE DISPENSER SYSTEM WITH REMOTE INGREDIENTS HANDLING

(71) Applicant: THE COCA-COLA COMPANY, Atlanta, GA (US)

(72) Inventors: Shaun B. Gatipon, Kennesaw, GA (US); Daniel S. Quartarone, Stone Mountain, GA (US)

(73) Assignee: THE COCA-COLA COMPANY, Atlanta, GA (US)

( * ) Notice: Subject to any disclaimer, the term of this patent is extended or adjusted under 35 U.S.C. 154(b) by 385 days.

(21) Appl. No.: 15/310,664

(22) PCT Filed: May 12, 2015

(86) PCT No.: PCT/US2015/030315
§ 371 (c)(1),
(2) Date: Nov. 11, 2016

(87) PCT Pub. No.: WO2015/175494
PCT Pub. Date: Nov. 19, 2015

(65) Prior Publication Data

US 2017/0081163 A1 Mar. 23, 2017

Related U.S. Application Data

(60) Provisional application No. 61/991,956, filed on May 12, 2014.

(51) Int. Cl.

| | |
|---|---|
| ***B67D 1/08*** | (2006.01) |
| ***B67D 1/06*** | (2006.01) |
| ***B67D 1/00*** | (2006.01) |

(52) U.S. Cl.
CPC ..... *B67D 1/0037* (2013.01); *B67D 1/004* (2013.01); *B67D 1/0078* (2013.01); *B67D 1/06* (2013.01);
(Continued)

(58) Field of Classification Search
CPC .... B67D 1/0021; B67D 1/004; B67D 1/0054; B67D 1/006; B67D 1/0857; B67D 1/0861;
(Continued)

(56) References Cited

U.S. PATENT DOCUMENTS 3,991,911 A * 11/1976 Shannon ..... B67D 1/0041 222/129.4
4,406,382 A 9/1983 Roth
(Continued)

FOREIGN PATENT DOCUMENTS

GB 2 303 354 A 2/1997
WO 99/37578 A1 7/1999

*Primary Examiner* — Patrick M. Buechner
(74) *Attorney, Agent, or Firm* — Eversheds Sutherland (US) LLP

(57) ABSTRACT

A beverage dispenser system with remote ingredients handling. The beverage dispenser system includes at least one dispenser having a nozzle. Micro-ingredients and macro-ingredients are remotely positioned such as under the counter or in a back room to physically separate the micro-ingredients and macro-ingredients from the dispenser. Pumps or metering devises for providing the micro-ingredients and the macro-ingredients are also physically separated from the dispenser. The beverage system may also include a heat exchanger for cooling the macro-ingredients as well as still water and carbonated water. The heat exchanger may be positioned in the dispenser, on the dispenser, under the counter, or within the counter.

11 Claims, 12 Drawing Sheets

(52) U.S. Cl.
CPC ..... *B67D 1/0862* (2013.01); *B67D 1/0888* (2013.01)

(58) Field of Classification Search
CPC .. B67D 1/0862; B67D 1/0864; B67D 1/0865; B67D 1/0888; B67D 2001/0097; B67D 2001/0821; B67D 2210/00028; B67D 2210/00031; B67D 2210/00081; B67D 2210/00086; B67D 2210/00089; B67D 2210/0012; B67D 2210/00125; B67D 1/0037; B67D 1/0078
See application file for complete search history.

(56) References Cited

U.S. PATENT DOCUMENTS 4,582,226 A * 4/1986 Doak ..... B08B 9/0323 137/240
4,708,266 A 11/1987 Rudick
4,781,310 A * 11/1988 Credle, Jr. ..... B67D 1/0021 222/129.1
4,821,925 A * 4/1989 Wiley ..... B67D 1/0035 137/606
5,228,312 A * 7/1993 Williams ..... B67D 1/0867 165/140
5,350,082 A * 9/1994 Kiriakides, Jr. ..... G07F 13/065 221/1
5,363,671 A 11/1994 Forsythe et al.
6,598,417 B1 * 7/2003 Wilkes ..... B67D 1/0861 222/146.6
7,305,847 B2 * 12/2007 Wolski ..... B67D 1/0003 222/146.6
7,806,294 B2 * 10/2010 Gatipon ..... B67D 1/0022 222/1
7,997,448 B1 8/2011 Leyva
8,490,829 B2 * 7/2013 Deo ..... B67D 1/0027 222/129.4
2003/0101735 A1 * 6/2003 Teague ..... A23G 9/28 62/70
2004/0045983 A1 * 3/2004 McCann ..... B67D 1/0021 222/146.6
2004/0099688 A1 * 5/2004 Davis ..... B67D 1/0037 222/145.1
2006/0059940 A1 * 3/2006 Hess ..... B67D 1/0864 62/389
2007/0205221 A1 * 9/2007 Carpenter ..... B67D 1/0051 222/129.4
2009/0095771 A1 * 4/2009 Hoover ..... B67D 1/0022 222/129.1
2009/0125457 A1 5/2009 Farhan et al.
2009/0159612 A1 * 6/2009 Beavis ..... A47J 31/36 222/52
2010/0005903 A1 * 1/2010 Beavis ..... B67D 1/0036 73/861.47
2010/0163572 A1 * 7/2010 Downham ..... B67D 1/0004 222/1
2011/0017776 A1 * 1/2011 Metropulos ..... B67D 1/0041 222/129.1
2012/0298693 A1 11/2012 Jersey et al.
2012/0325845 A1 12/2012 Newman et al.
2013/0098849 A1 * 4/2013 Doyle ..... E04H 4/1281 210/754
2013/0277394 A1 * 10/2013 Edwards ..... B67D 1/0891 222/144.5

* cited by examiner 10
12
DISPENSING TOWER
USER INTERFACE
18
HUMAN MACHINE INTERFACE (HMI)
40
EXTERNAL DEVICE(S)
46
50
14
MICRO INGREDIENT TOWER
MICRO INGREDIENT
20
MICRO INGREDIENT PUMP
30
MACRO INGREDIENT
22
MACRO INGREDIENT PUMP
32
CORE DISPENSE MODULE (CDM)
42
NOZZLE
16
HEAT EXCHANGER
52
STILLWATER SOURCE
36
CARBONATED WATER SOURCE
38

FIG. 7
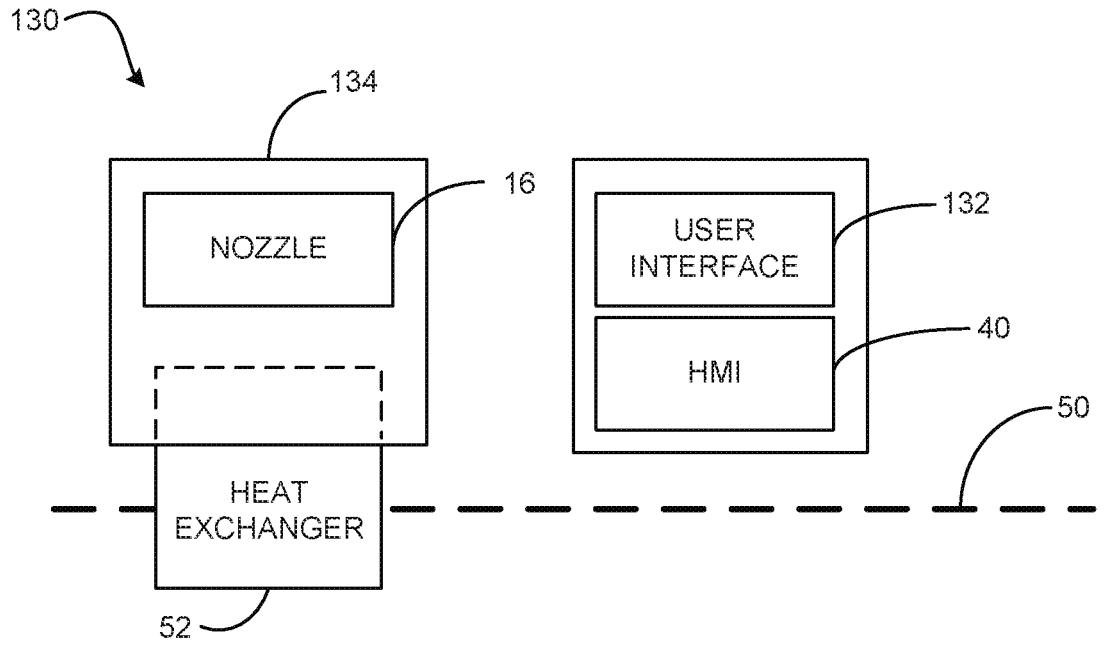
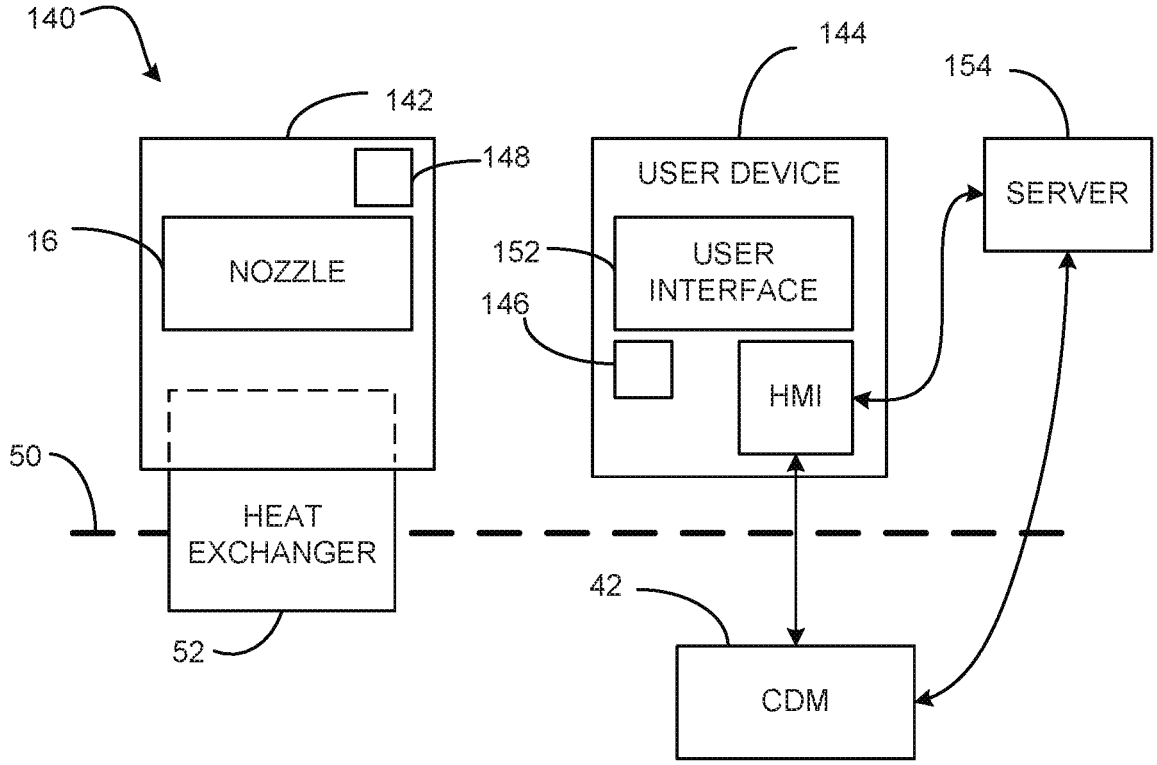
FIG. 8

BEVERAGE DISPENSER SYSTEM WITH REMOTE INGREDIENTS HANDLING

CROSS-REFERENCE TO RELATED APPLICATION(S)

This application is a U.S. national stage application of international application number PCT/US2015/030315, filed on May 12, 2015, which claims the benefit of U.S. Provisional Patent Application No. 61/991,956, filed on May 12, 2014, the disclosures of which are incorporated by reference in their entirety.

BACKGROUND

Modern product dispensers provide enhanced functionality such as custom beverages and user interface displays. The modern product dispenser includes multiple ingredient packages so that each of the ingredients is separated from one another. The ingredient packages may typically be housed within an ingredient tower. The ingredients tower may include a corresponding number of pumps and valves for each of the ingredient packages. The pumps deliver the required ingredients to the nozzle of the dispenser based on a request for a particular beverage received at the user interface. Product dispensers are sized for different types of environments and needs. For example, scaling up in size can increase the variety of product offerings which results in additional ingredient packages. The ingredient packages and the associated pumps take up space when included as part of the dispenser or when positioned above the counter, which limits the type and number of dispensers that may be used in an economy of space.

SUMMARY

It should be appreciated that this Summary is provided to introduce a selection of concepts in a simplified form that are further described below in the Detailed Description. This Summary is not intended to be used to limit the scope of the claimed subject matter.

According to one embodiment disclosed herein, a product dispensing system is provided. The product dispensing system includes at least one dispenser having a nozzle for dispensing a product about the nozzle. The product dispensing system also includes at least one micro-ingredient and at least one macro-ingredient. At least one pump or metering device communicates with each of the micro-ingredient and the macro-ingredient. The micro-ingredient, the macro-ingredient and the pumps or metering devices are remotely positioned from the dispenser. The product dispensing system also includes a heat exchanger for cooling the macro-ingredient. The heat exchanger may be positioned on the dispenser, in the dispenser, below the counter or within the counter.

According to another embodiment disclosed herein, a beverage dispensing system is provided. The beverage dispensing system includes a dispenser having a nozzle for dispensing a beverage about the nozzle. The beverage dispensing system also includes a plurality of micro-ingredients, a plurality of macro-ingredients, and a plurality of pumps or metering devices. Each of the plurality of pumps or metering devices communicates with a corresponding one of the plurality of micro-ingredients and the plurality of macro-ingredients. The beverage dispensing system also includes a core dispensing module (CDM) for controlling each of the plurality of pumps or metering devices. The system includes a still water source communicating with the dispenser and a carbonated water source communicating with the dispenser. A heat exchanger cools the plurality of macro-ingredients, the still water source and the carbonated water source and the plurality of micro-ingredients, the plurality of macro-ingredients, the plurality of pumps or metering devices, the CDM, and the carbonated water source are remotely positioned from the dispenser.

According to yet another embodiment disclosed herein, a method of dispensing a beverage is provided. The method includes providing a dispenser having a nozzle, remotely positioning at least one micro-ingredient, remotely positioning at least one macro-ingredient, and cooling the at least one macro-ingredient. The method also includes receiving a request for a beverage and, in response to receiving the request, pumping at least one of the at least one micro-ingredient and the at least one macro-ingredient to the dispenser. The method then includes dispensing the beverage about the nozzle.

According to still yet another embodiment disclosed herein, a method of dispensing a beverage is provided. The method of dispensing a beverage includes providing a first dispenser and a second dispenser, providing a micro-ingredient, and providing a macro-ingredient. The method also includes cooling the macro-ingredient and receiving a first request for a beverage at the first dispenser. In response to receiving the first request, the method includes pumping at least one of the micro-ingredient and the macro-ingredient to the first dispenser. The method also includes receiving a second request for another beverage at the second dispenser, and in response to receiving the second request, pumping at least one of the micro-ingredient and the macro-ingredient to the second dispenser.

According to another embodiment disclosed herein, a product dispenser is provided. The product dispenser includes a user interface configured for requesting a product and a nozzle configured for dispensing the product. The user interface and the nozzle are oppositely disposed from one another on the product dispenser. Upper and lower portions of the dispenser may be rotatably coupled together such that the upper portion rotates at least partially relative to the lower portion.

The features, functions, and advantages that have been discussed can be achieved independently in various embodiments of the present disclosure or may be combined in yet other embodiments, further details of which can be seen with reference to the following description and drawings.

BRIEF DESCRIPTION OF THE DRAWINGS

The embodiments presented herein will become more fully understood from the detailed description and the accompanying drawings, wherein:

FIG. 7 illustrates one configuration of a product dispenser system having dispenser with a detachable user interface, in accordance with various embodiments disclosed herein, FIG. 8 illustrates one configuration of a product dispenser system having dispenser utilizing a mobile computing device to interface with the dispenser, in accordance with various embodiments disclosed herein.

Figure 1:
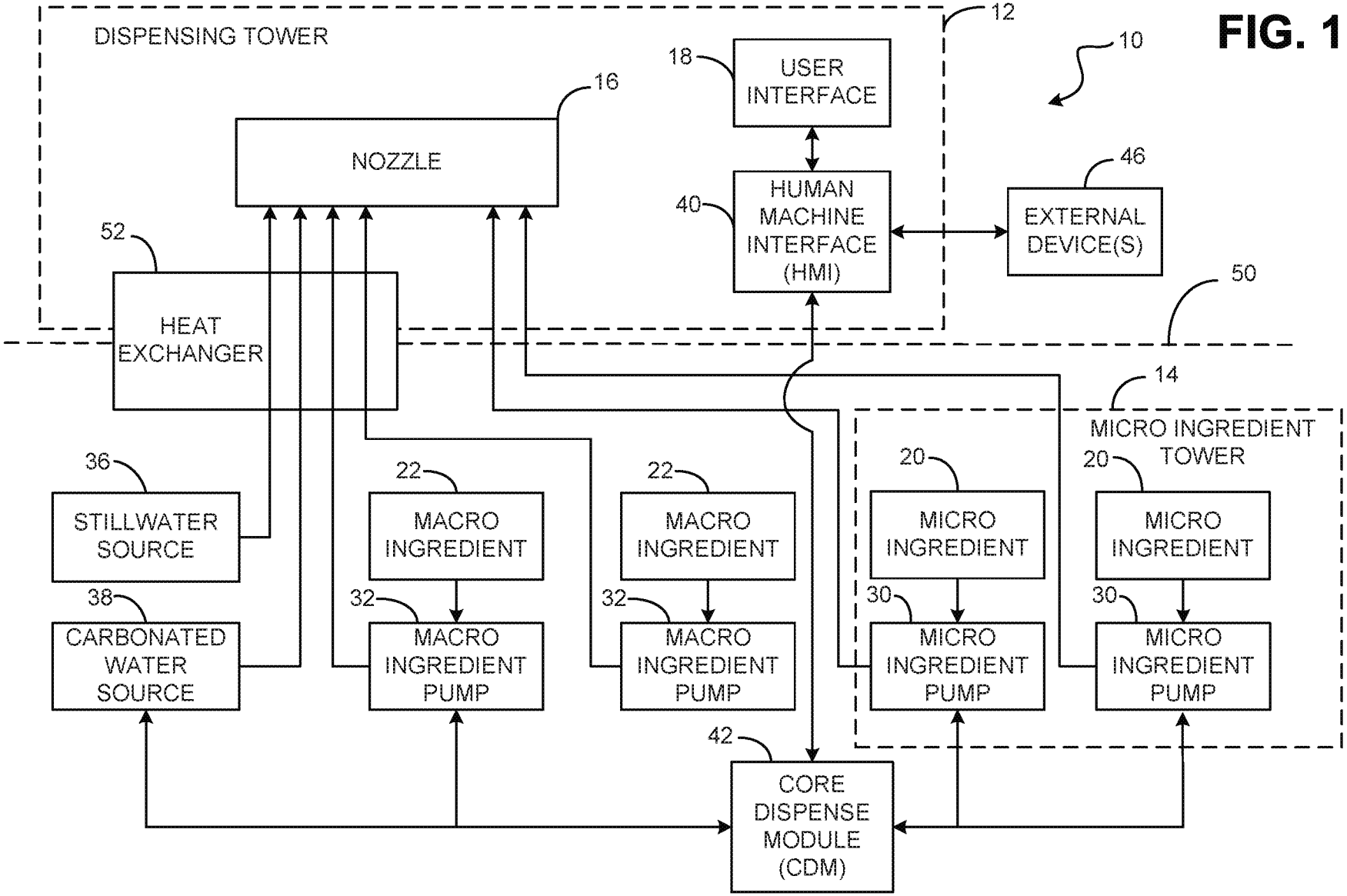
FIG. 1 illustrates a block diagram of one configuration of a product dispensing system wherein a dispensing tower is positioned on a counter and a micro-ingredients tower, macro-ingredients, and pumps for delivering the micro-ingredients and macro-ingredients are positioned remotely from the dispensing tower, in accordance with various embodiment disclosed herein.

The plurality of figures presented in this application illustrates variations and different aspects of the embodiments of the present disclosure. Accordingly, the detailed description on each illustration will describe the differences identified in the corresponding illustration.

DETAILED DESCRIPTION

The following detailed description is directed to product dispenser systems such as beverage dispenser systems for mixing and dispensing beverages. The present inventions are susceptible of embodiment in many different forms. There is no intent to limit the principles of the present inventions to the particular disclosed embodiments. In the following detailed description, references are made to the accompanying drawings that form a part hereof and in which are shown by way of illustration specific embodiments or examples. Referring to the drawings, in which like numerals represent like elements throughout the several figures, aspects of the present disclosure will be presented.

The term "beverage," as used herein, includes, but is not limited to, pulp and pulp-free citrus and non-citrus fruit juices, fruit drink, vegetable juice, vegetable drink, milk, soy milk, protein drink, soy-enhanced drink, tea, water, isotonic drink, vitamin-enhanced water, soft drink, flavored water, energy drink, coffee, smoothies, yogurt drinks, hot chocolate and combinations thereof. The beverage may also be carbonated or non-carbonated. The beverage may comprise beverage components (e.g., beverage bases, colorants, flavorants, and additives).

The term "beverage base" refers to parts of the beverage or the beverage itself prior to additional colorants, additional flavorants, and/or additional additives. According to certain embodiments of the present inventions, beverage bases may include, but are not limited to syrups, concentrates, and the like that may be mixed with a diluent such as still or carbonated water or other diluent to form a beverage. The beverage bases may have reconstitution ratios of about 3:1 to about 6:1 or higher. According to certain embodiments, beverage bases may comprise a mixture of beverage base components.

The term "beverage base component" refers to components which may be included in beverage bases. According to certain embodiments of the present inventions, the beverage base component may comprise parts of beverages which may be considered food items by themselves. According to certain embodiments of the present inventions, the beverage base components may be micro-ingredients such as an acid portion of a beverage base, an acid-degradable and/or non-acid portion of a beverage base, natural and artificial flavors, flavor additives, natural and artificial colors, nutritive or non-nutritive natural or artificial sweeteners, additives for controlling tartness (e.g., citric acid or potassium citrate), functional additives such as vitamins, minerals, or herbal extracts, nutraceuticals, or medicaments. The micro-ingredients may have reconstitution ratios from about 10:1, 20:1, 30:1, or higher with many having reconstitution ratios of 50:1 to 300:1. The viscosities of the micro-ingredients may range from about 1 to about 100 centipoise.

Thus, for the purposes of requesting, selecting, or dispensing a beverage base, a beverage base formed from separately stored beverage base components may be equivalent to a separately stored beverage base. For the purposes of requesting, selecting or dispensing a beverage, a beverage formed from separately stored beverage components may be equivalent to a separately stored beverage.

By "separately stored" it is meant that the components of the present inventions are kept separate until combined. For instance, the components may be separately stored individually in a container or package or instead may be all stored in one container or package wherein each component is individually packaged (e.g., plastic bags) so that they do not blend while in the container or package. In some embodiments, the container or package, itself, may be individual, adjacent to, or attached to another container or package.

The product ingredients may include beverage bases or beverage base components (e.g., concentrated syrups) as well as flavors (i.e., flavoring agents, flavor concentrates, or flavor syrups), which may be separately stored or otherwise contained in individual removable containers. In accordance with one or more embodiments, each of the beverage bases or beverage base components and each of the flavors may be separately stored or otherwise contained in individual removable containers, cartridges, packages or the like which may generally be referred to simply as a "package" or "ingredients package" with one or more applicable reference numbers.

FIG. 1 illustrates a block diagram of one configuration of a product dispensing system 10. The product dispensing system 10 includes a dispensing tower 12 and a micro-ingredient tower 14. The dispensing tower 12 includes a nozzle 16 and a user interface 18. Examples of such a nozzle 16 are described in U.S. patent application Ser. No. 14/265,632, the entirety of which is hereby incorporated by reference. The nozzle 16 may combine the flows from the plurality of pumps and/or valves to mix and dispense the product such as a beverage into a container such as a cup. The mixing of the beverage may occur prior to, during, and/or following dispense of the flows from the nozzle 16. Dispensing to, during, and or/following dispense of the flows may be generally and collectively referred to as dispensing about the nozzle 16 and may be within or proximate to the container suitable to hold such a beverage.

Examples of such a user interface 18 are described in U.S. Patent Publication No. 2015/0082243, entitled Product Categorization User Interface for a Dispensing Device, filed on Sep. 13, 2013, the entirety of which is hereby incorporated by reference. The micro-ingredient tower 14 includes packages of micro-ingredients 20. The product dispensing system 10 also includes packages of macro-ingredients 22. Although FIG. 1 depicts two packages of micro-ingredients 20 and two packages of macro-ingredients 22, aspects of this disclosure contemplate any number of packages of micro-ingredients 20 and any number of packages of macro-ingredients 22 depending on the type and capacity of the product dispensing system 10. Examples of such beverage forming packages are described in U.S. Pat. No. 9,394,154, Beverage Dispenser Container and Carton, filed Mar. 13, 2014, the entirety of which is hereby incorporated by reference.

The dispensing tower 12 may automatically identify the ingredient packages holding the micro- and macro-ingredients 20, 22 upon installation by a user or the user may be prompted to identify the ingredient packages when they are installed. It should be appreciated that the aforementioned beverage components (i.e., beverage bases or beverage base components and flavors) may be combined, along with other beverage ingredients, to dispense various products which may include beverages or blended beverages (i.e., finished beverage products) from the dispensing tower 12. It should be understood, however, that the dispensing tower 12 may also be configured to dispense beverage components individually. In some embodiments, the dispensing tower 12 may be configured to dispense beverage base components so as to form a beverage base or finished beverage. The other beverage ingredients may include diluents such as still or carbonated water, functional additives, or medicaments, for example.

The product dispensing system 10 may also include any number of pumps, nozzles, valves, carbonation systems, ice handling systems, and other fluid handling systems for dispensing a beverage product. FIG. 1 depicts a pair of pumps 30 corresponding with the packages of micro-ingredients 20 and another pair of pumps 32 corresponding with the packages of macro-ingredients 22. The packages of micro-ingredients 20 and the packages of the macro-ingredients 22 communicate with the nozzle 16 so that the micro-ingredients 20 and the macro-ingredients 22 may be pumped to the dispensing tower 12. Still water and carbonated water may also be provided to the dispensing tower 12 from a still water source 36 and a carbonated water source 38.

The product dispensing system 10 may further include a control architecture having a human machine interface (HMI) module 40 and a core dispense module (CDM) 42. An example of a control architecture for the product dispensing system is described in U.S. Patent Publication No. 2016/0325980, entitled Dispenser Control Architecture, filed on May 1, 2014, the entirety of which is hereby incorporated by reference. A machine bus (MBUS) facilitates communication between the HMI module 40 and the CDM 42. The HMI module 40, the MBUS, and the CDM 42 may collectively comprise common core components, implemented as hardware or as combination of hardware and software, which may be adapted to provide customized functionality in the product dispensing system 10. The product dispensing system 10 may further include memory storage and a processor.

It should be understood that the common core components in the control architecture described herein may be utilized across a number of dispenser types/platforms, each having different equipment requirements. For example, the common core components may be utilized in a family of dispensers comprising a small beverage dispenser (e.g., for use in a home or small office setting) comprising a limited number of beverage pumps and associated equipment (e.g., nozzles, etc.), a medium sized beverage dispenser (e.g., for use in a commercial setting) comprising a larger number of beverage pumps and associated equipment, and a large beverage dispenser (e.g., for use in a large commercial or industrial setting) comprising an even larger number of beverage pumps and associated equipment. In some embodiments, the pumps in each of the different dispensers in a family of dispensers may be different types or sizes of pumps. The HMI module 40 and the CDM 42 may be customized through the use of adapters (e.g., configuration files comprising application programming interfaces (APIs)) to provide customized user interface views and equipment behavior for the product dispensing system 10.

In some embodiments, the user interface 18 in the dispensing tower 12 may be utilized to select and individually dispense one or more beverages. The beverages may be dispensed as beverage components in a continuous pour operation whereby one or more selected beverage components continue to be dispensed while a pour input is actuated by a user or in a batch pour operation whereby a predetermined volume of one or more selected beverage components are dispensed (e.g., one ounce at a time). The user interface 18 may be addressed via a number of methods to select and dispense beverages. For example, a user may interact with the user interface 18 via touch input to navigate one or more menus from which to select and dispense a beverage. As another example, a user may type in a code using an onscreen or physical keyboard (not shown) on the dispensing tower 12 to navigate one or more menus from which to select and dispense a beverage.

The user interface 18, which may include a touch screen and a touch screen controller, may be configured to receive various commands from a user (i.e., consumer input) in the form of touch input, generate a graphics output and/or execute one or more operations with the dispensing tower 12 (via the HMI 40 and/or the CDM 42), in response to receiving the aforementioned commands. A touch screen driver in the HMI module 40 may be configured to receive the consumer or customer inputs and generate events (e.g., touch screen events) which may then be communicated through a controller to an operating system of the HMI 40.

The dispensing tower 12 may be in communication with one or more external devices 46. In some embodiments, the communication between the dispensing tower 12 and the external devices 46 may be accomplished utilizing any number of communication techniques known to those skilled in the art including, but not limited to, near-field wireless technology such as BLUETOOTH, Wi-Fi and other wireless or wireline communication standards or technologies, via a communication interface.

The external devices 46 may include, without limitation, a smartphone, a tablet personal computer, a laptop computer, biometric sensors and the like. In some embodiments, the external device 46 may be utilized to receive user interface views from the HMI 40 which may be in lieu of or in addition to user interface views displayed in the user interface 18 of the dispensing tower 12. For example, in some embodiments, the dispensing tower 12 may be configured for "headless" operation in which graphics and other user interface elements are displayed on a customer's smartphone instead of on the dispensing tower 12.

FIG. 1 also depicts a broken line 50 to illustrate that the micro-ingredient tower 14 is remotely positioned from the dispensing tower 12. The term "remotely positioned" as used herein refers to defining a physical separation between the dispensing tower 12 and the micro-ingredient tower 14. For example, the dispensing tower 12 may be placed on top of a counter and the micro-ingredient tower 14, having the micro-ingredients 20, may be placed under the counter or in a back room. The terms "under the counter" and 'back room" are commonly used in the beverage dispensing industry and should be interpreted as having the ordinary and customary meaning as understood by those skilled in the art of beverage dispensing. For example, a counter can be surface upon which objects, such as the dispensing tower 12, are placed. The space underneath the counter would constitute the "under the counter" as used herein.

In one embodiment, the dispensing tower 12 may have a physical separation of at least one foot from the micro-ingredient tower 14. In another embodiment, the dispensing tower 12 may have a physical separation of at least ten feet from the micro-ingredient tower 14. In one or more embodiments, the macro-ingredients 22, the pumps 30, 32, the still water and carbonated water sources 36, 38, and/or the CDM 42 are also remotely positioned from the dispensing tower 12. For example, the macro-ingredients 22, the pumps 30, 32, the still water and carbonated water sources 36, 38, and/or the CDM 42 may have a physical separation of at least one foot, or at least ten feet, from the dispensing tower 12. In one or more embodiments, the micro-ingredients 20, the macro-ingredients 22, the pumps 30, 32, and/or the CDM 42 are further away from the dispensing tower 12 than is the heat exchanger 52. In one or more embodiments, the micro-ingredients 20, the macro-ingredients 22, the pumps 30, 32, and/or the CDM 42 are closer to the still water source 36 or the carbonated water source 38 than to the dispensing tower 12.

The product dispensing system 10 of FIG. 1 also illustrates a heat exchanger 52. The heat exchanger 52 preferably is either a tube-in-tube heat exchanger, a cold plate, or a clam shell heat exchanger. Examples of such a cold plate is described in U.S. Patent Publication No. 2016/0347596 titled COOLING SYSTEM FOR BEVERAGE DISPENSERS AND METHODS OF MAINTAINING A COOLING SYSTEM, filed Dec. 26, 2013, the entirety of which is hereby incorporated by reference. In certain examples, the cold plate may be arranged and configured with embedded coils or tubes therein for which fluids travel through to be chilled to an appropriate temperature before being served from the dispensing tower 12. In other examples, the cold plate may include a plurality of fluidic channels integrated (e.g. monolithically formed) therein. The heat exchanger construction helps to increase the surface area to allow for more efficient heat transfer to occur. The cold plate may be positioned within or form a portion of an ice retaining bin (FIG. 5) such that a layer of ice water contacts the cold plate. The ice water causes heat exchange between the cold plate and the ice water. Macro-ingredients 22, still water from the still water source 36, and carbonated water from the carbonated water source 38 can then flow through the cold plate and be chilled prior to entering the nozzle 16. Other types of heat exchangers known to those skilled in the art may also be utilized.

It is desirable to have the distance of the lines between the nozzle 16 and the heat exchanger 52 be as short as possible to prevent heat loss. Products sitting in uninsulated lines at ambient temperature could adversely affect the quality of the dispensed beverage. Therefore, it is preferable to have the heat exchanger 52 be on the dispensing tower 12, incorporated into the dispensing tower 12, incorporated into the counter, or under the counter close to the dispensing tower 12. In some embodiments, the broken line 50 corresponds with the counter upon which the dispensing tower 12 sits. In such case, the heat exchanger 52 in FIG. 1 is depicted as overlapping the broken line 50 to illustrate the placement options of the heat exchanger 52 as explained above. The macro-ingredients 22, the still water from the still water source 36, and the carbonated water from the carbonated water source 38 may pass through the heat exchanger 52 to be cooled by transferring heat to the heat exchanger 52 so that beverage mixes well and is cool when dispensed. It is not necessary to pass the micro-ingredients 20 through the heat exchanger 52 because of their high concentration (i.e. not dispensing a large volume) which therefore typically does not affect the temperature of the dispensed beverage.

Figure 2:
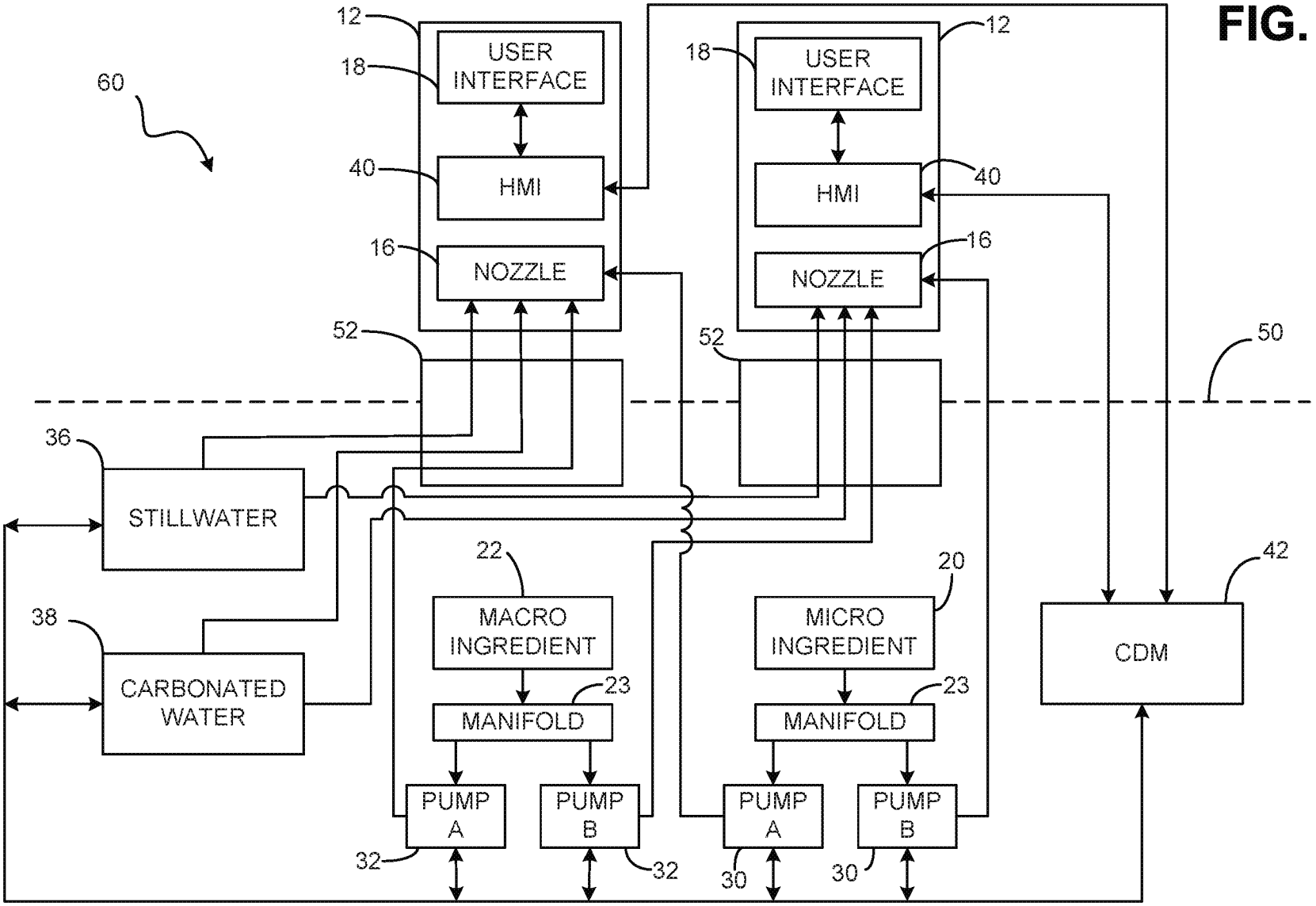
FIG. 2 illustrates a block diagram of one configuration of a product dispensing system wherein multiple dispensing towers are is positioned on a counter and micro-ingredients, macro-ingredients, and pumps for delivering the micro-ingredients and macro-ingredients are positioned remotely from the dispensing towers, wherein a single package of ingredients supports the multiple dispensers, in accordance with various embodiment disclosed herein.

FIG. 2 illustrates one configuration of a product dispensing system 60 having at least a pair of dispensing towers 12. For example, a counter may have two or more dispensing towers 12 to serve more customers. Although FIG. 2 depicts the product dispensing system 60 with two dispensing towers 12, aspects of this disclosure may contemplate more than two dispensing towers 12 depending on the type and capacity of the product dispensing system 60. Each of the dispensing towers 12 has an associated heat exchanger 52. FIG. 2 also depicts a single package of micro-ingredients 20 and a single package of macro-ingredients 22 communicating with both of the dispensing towers 12. Therefore, the single package of micro-ingredients 20 serves more than one dispensing tower 12 and the single package of macro-ingredients 22 serves more than one dispensing tower 12. As shown in FIG. 2, a first pump 30 provides the micro-ingredient 20 to one of the dispensing towers 12 and a second pump 30 provides the micro-ingredient 20 to the other of the dispensing towers 12. A third pump 32 provides the macro-ingredient 22 to one of the dispensing towers 12 and a fourth pump 32 provides the macro-ingredient 22 to the other of the dispensing towers 12. The first, second, third and fourth pumps 30, 32 may be controlled by a single CDM 42.

In the example shown, a manifold 23 is positioned between the micro-ingredient 20, macro-ingredient 22 and the pumps 30, 32. The manifold 23 generally dispenses micro- and macro-ingredients from a single source to multiple pumps. For instance, the micro-ingredient 20 can be a pouch or bag located within a package or box or carton. The pouch or bag can include a fitment, probe or other connector that interfaces with the manifold 23. The manifold 23, in turn, is coupled to each of the pumps 30 through fitments, probes, or other connectors. Other configurations are possible.

The CDM 42 is programmed to control various aspects of the product dispensing system 60, including one or more of the HMI modules 40, pumps 30, 32, and still and carbonated water sources 36, 38. While the schematic view shows control signals delivered generally to these components, such as the still and carbonated water sources 36, 38, the control signals can be provided to various valves associated with these components to control the flows, as described below.

Figure 3:
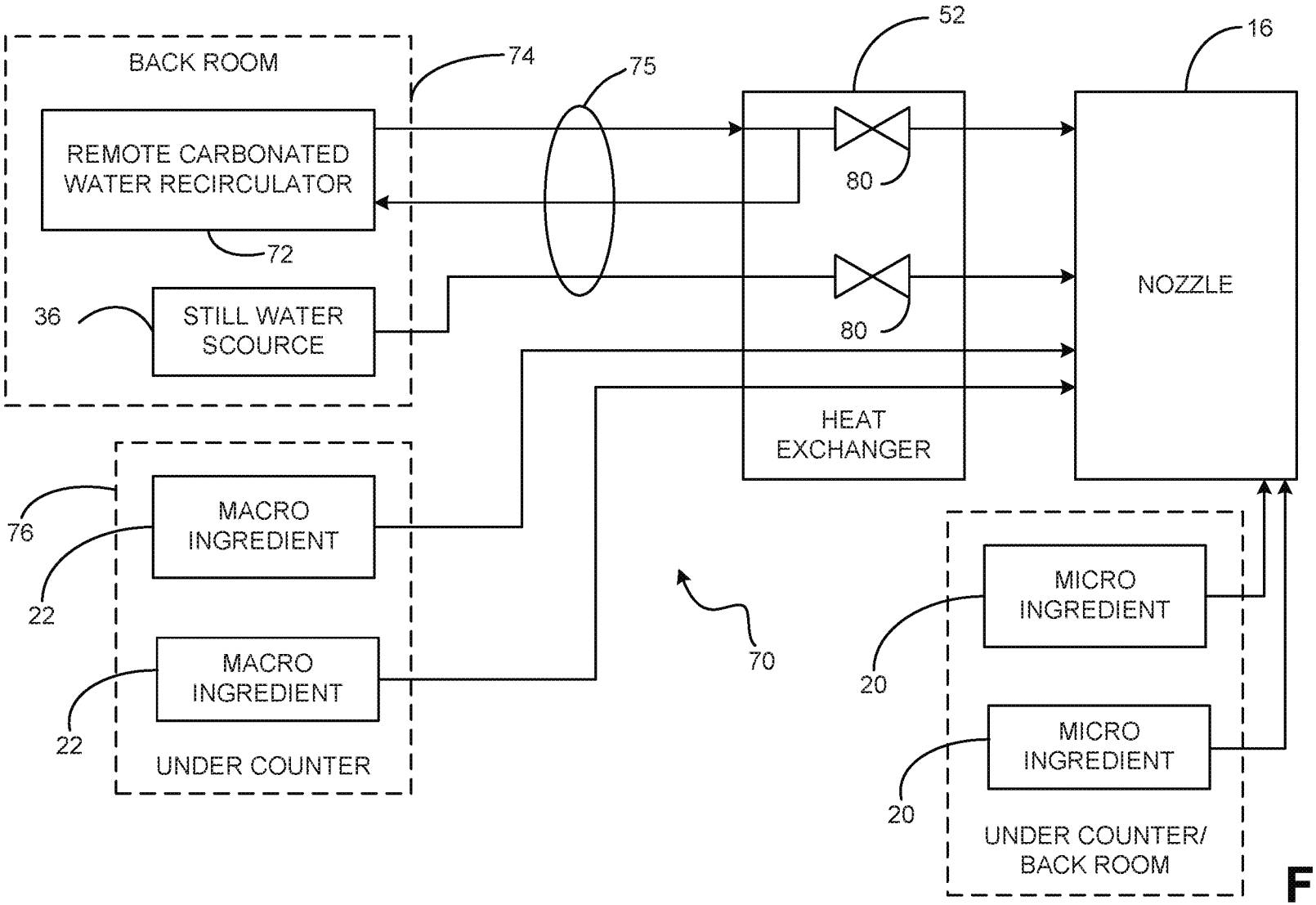
FIG. 3 illustrates a block diagram of one configuration having a remote carbonated water circulator communicating with a heat exchanger and carbonated water is recirculated between the carbonated water recirculator and the heat exchanger and cold carbonated water is provided to the nozzle, in accordance with various embodiments disclosed herein.

FIG. 3 illustrates one configuration of a product dispensing system 70 having a remote carbonated water recirculator 72. The remote carbonated water recirculator 72 may be remotely positioned in a back room 74 along with the still water source 36. FIG. 3 also illustrates macro-ingredients 22 remotely positioned under counter 76. The remote carbonated water recirculator 72 communicates with the heat exchanger 52 to define a recirculation loop 78 where carbonated water is recirculated between the carbonated water recirculator 72 and the heat exchanger 52. In one or more embodiments, the line for the still water from the still water source 36 may be bundled with the recirculation loop 78 to exchange heat from the still water to the cold carbonated water and thereby cool the still water before the still water passes into the heat exchanger 52. See FIG. 4B. The heat exchanger 52 may also include a shutoff valve 80 for providing cold carbonated water from the recirculation loop 78 to the nozzle 16. Another shutoff valve 80 may be used to provide still water from the still water source 36, which has been cooled by the heat exchanger 52, to the nozzle 16. The shutoff valves 80 may be positioned outside of the heat exchanger 52. The micro-ingredients 20 can similarly be positioned either under the counter or in the back room. The micro-ingredients 20 can optionally be delivered through a heat exchanger, such as heat exchanger 52.

In this example, the fluids communicated between the back room and the heat exchanger 52 can be delivered using a link 75 commonly referred to as a python bundle or multiplexed conduit. The link 75 is described further below in reference to FIG. 4C.

Figure 4:
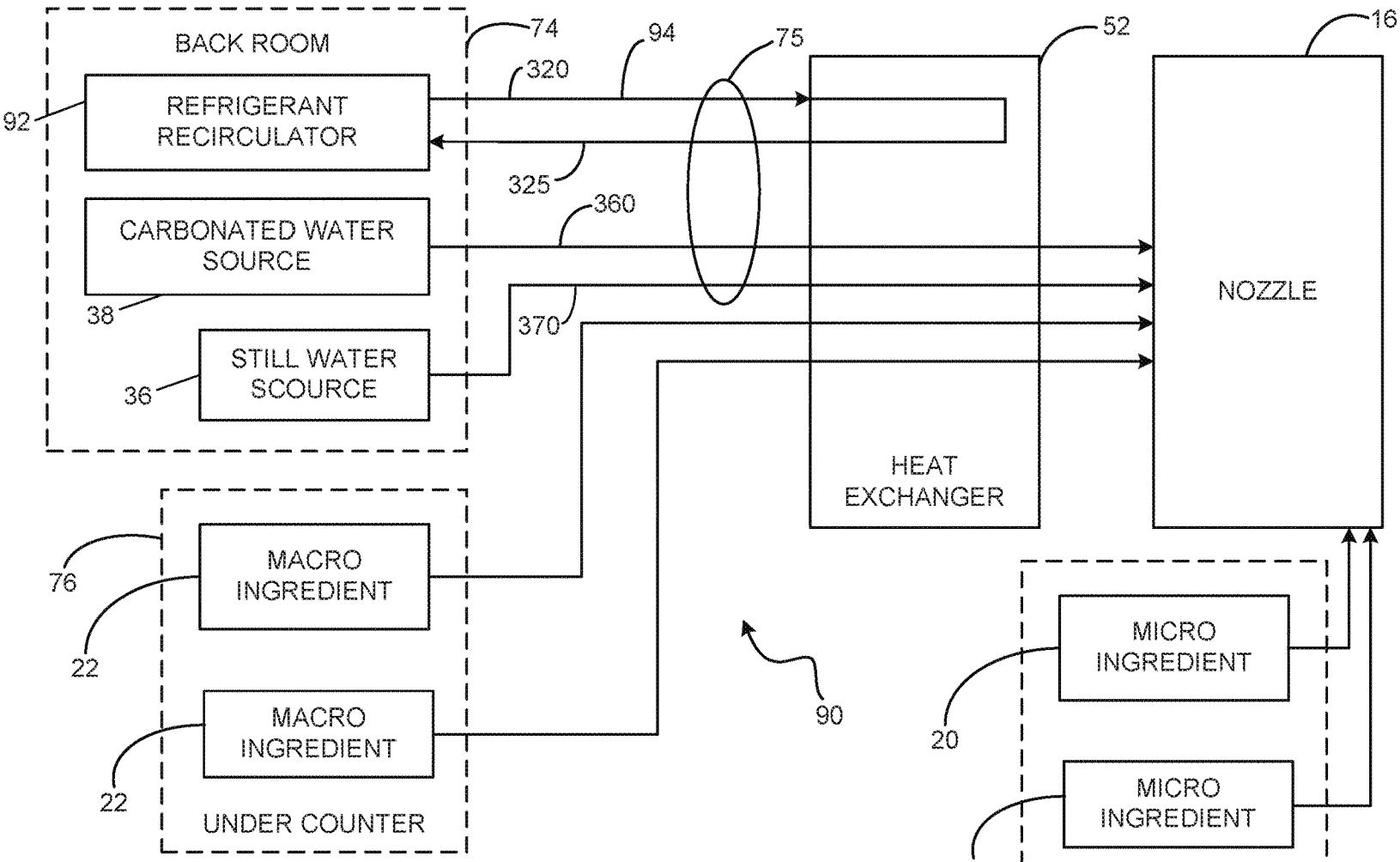
FIG. 4 illustrates a block diagram of one configuration having a refrigerant recirculator communicating with a heat exchanger and refrigerant is recirculated between the refrigerant recirculator and the heat exchanger, in accordance with various embodiments disclosed herein.

FIG. 4 illustrates one configuration of a product dispensing system 90 having a refrigerant recirculator 92 with a refrigerant such as propylene glycol, ethylene glycol or some other suitable alternative known to those skilled in the art. The refrigerant recirculator 92 may be remotely positioned in the back room 74 along with the still water source 36 and the carbonated water source 38. FIG. 4 also illustrates macro-ingredients 22 remotely positioned under counter 76. The refrigerant recirculator 92 communicates with the heat exchanger 52 to define a recirculation loop 94 where refrigerant is recirculated between the refrigerant recirculator 92 and the heat exchanger 52. In one or more embodiments, the lines for the still water from the still water source 36 and the carbonated water from the carbonated water source 38 may be bundled with the recirculation loop 94 to exchange heat from the still water and the carbonated water to the refrigerant in the recirculation loop 94 and thereby cool the still water and the carbonated water before passing into the heat exchanger 52, as described below. The micro-ingredients 20 can similarly be located under the counter or in the back room and be delivered in the same manner.

At least some of the fluids from the back room 74 can be delivered to the heat exchanger 52 and/or the nozzle 16 by the link 75. In the context of the product dispensing system 90, the refrigerant recirculator 92 and still and carbonated water sources 36, 38 are delivered by the link 75.

Figure 4A:
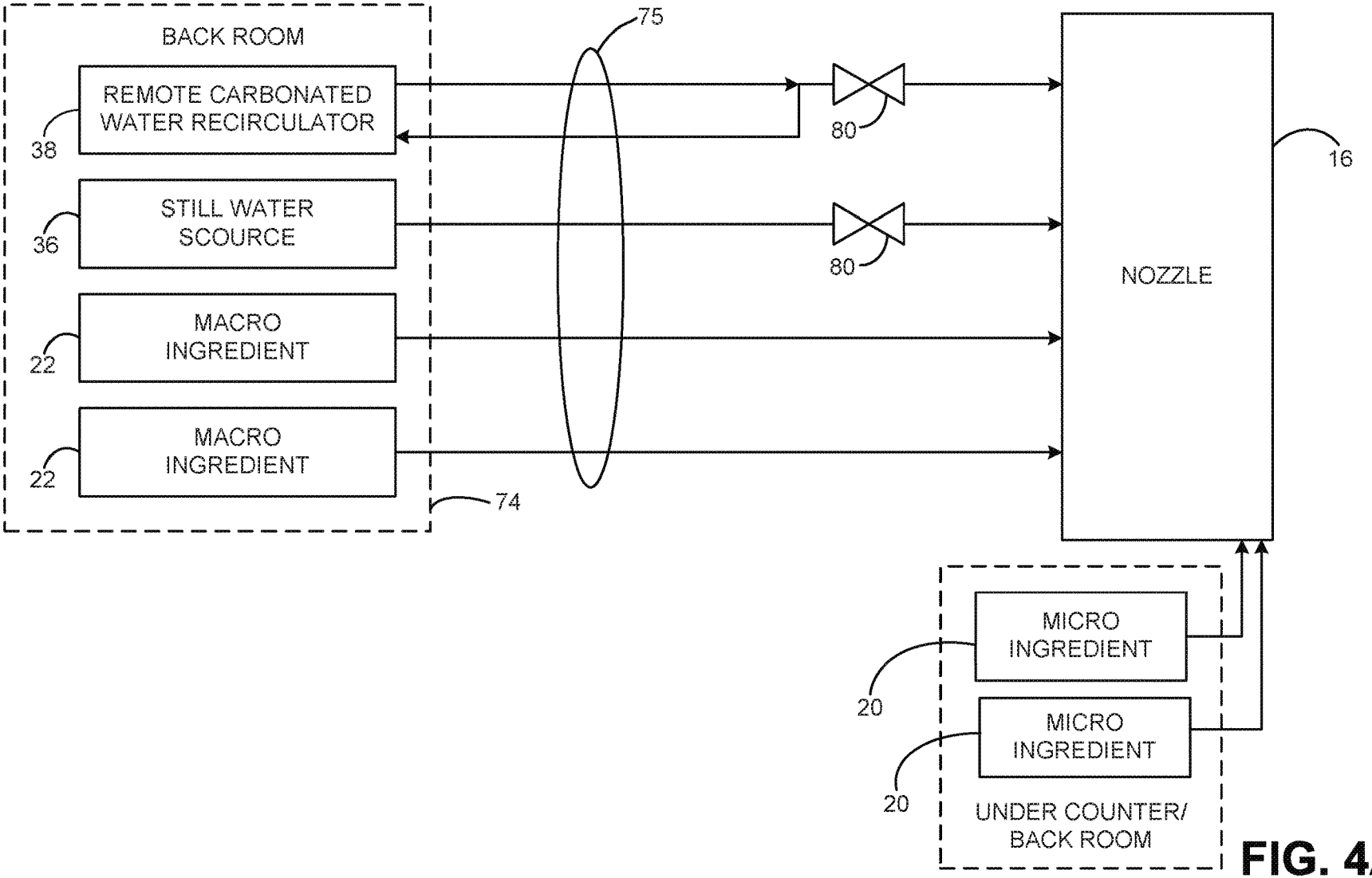
FIG. 4A illustrates a block diagram of one configuration of delivering carbonated and still waters and macro-ingredients through a python bundle, in accordance with various embodiments disclosed herein.

Referring now to FIG. 4A, the still and carbonated water sources 36, 38 are located in the back room 74 along with the macro-ingredients 22. All of these are delivered to the nozzle 16 by the link 75. The micro-ingredients 20 can similarly be located under the counter and/or in the back room and be delivered in a like manner.

Figure 4B:
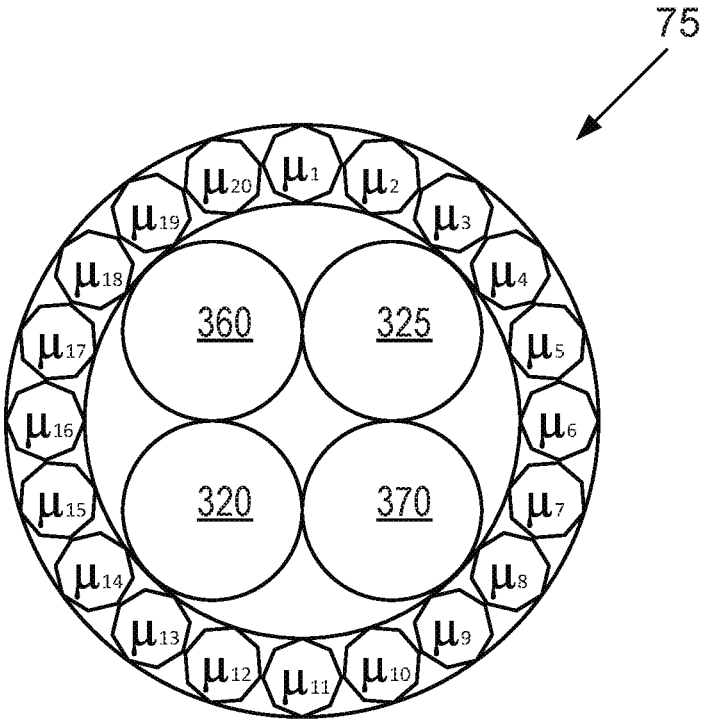
FIG. 4B illustrates a block diagram of one configuration of an example python bundle, in accordance with various embodiments disclosed herein.

Referring now to FIG. 4B, a cross-sectional representation of the example link 75 is shown. In this embodiment, all or part of the link 75 may comprise any type of flexible hose implemented to enable fluid communication between the various fluid sources located in the back room 74 and the nozzle 16. All or part of the link 75 may also be a rigid tube made from an individual material or a combination thereof. For example, the link 75 may include nylon, polyurethane, polyethylene, synthetic or natural rubbers, or manufactured from special grades of polyethylene. The link 75 may be insulated to preserve the temperature of the contents passing through.

As noted previously, the link 75 may commonly be referred to as a "python bundle" or a "multiplexed conduit" by those skilled in the art, comprising of a recirculation outlet connector 320 and a recirculation inlet connector 325, which define part of the recirculation loop 94, as well as a water output 360 and a water output 370. The exterior of the bundle of the recirculation outlet connector 320, the recirculation inlet connector 325, the water output 360 and the water output 370 is surrounded by insulation.

All or part of the exterior length of the insulation is then surrounded by one or more of the micro-ingredients μl-μ20. The micro-ingredients μl-μ20 may be on the outside of the insulation because the micro-ingredients μl-μ20 do not need to be refrigerated. All or part of the length of the one or more micro-ingredients μl-μ20 may then be surrounded by a protective layer or sheathing. The water output 370 may extend from the still water source 36 through the link 75 to the nozzle 16. Each of the micro-ingredients μl-μ20 may independently passed through the link 75 via connectors.

Also, in some embodiments, the recirculation loop may also serve to chill the macro-ingredients or the still water passing through the link 75 utilizing the chilled carbonated water. The macro-ingredients 22 may pass though the link 75 inside of the insulation along with or as part of the inner bundle of the recirculation outlet connector 320, the recirculation inlet connector 325, the water output 360 and the water output 370.

Figure 4C:
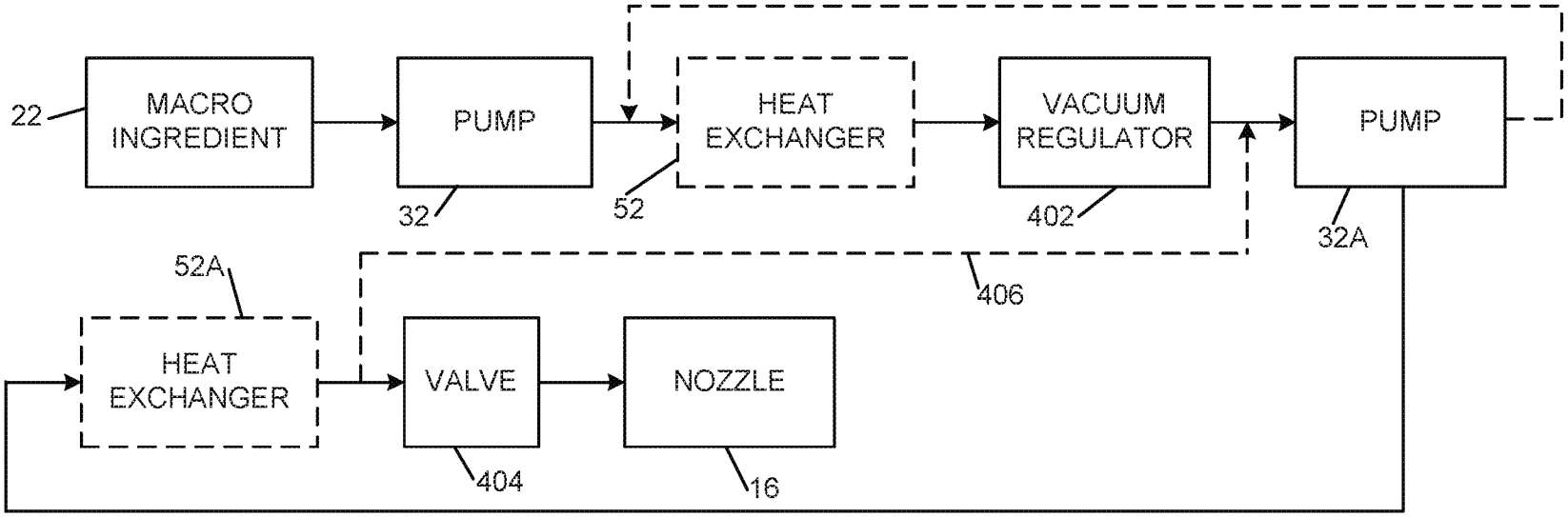
FIG. 4C illustrates a block diagram of another configuration of delivering macro-ingredients, in accordance with various embodiments disclosed herein

Referring now to FIG. 4C, an example configuration for delivery of one of the macro-ingredients 22 from a backroom and/or under the counter to a nozzle for dispensing is shown. In this example, the macro-ingredient 22 is pumped (directly or through a manifold) by a pump 32, such as a CO2 driven pump, thus creating a pressurized macro-ingredient line. The macro-ingredient 22 is pumped through an optional heat exchanger 52 to a vacuum regulator 402. The vacuum regulator 402 drops inlet fluid pressures to allow the fluid to be pumped by another pump 32A. In this example, the pump 32A can be, for example, a positive displacement, controlled gear pump, etc. located at or near the point of dispensing.

The pump 32A pumps the macro-ingredient 22 through another optional heat exchanger 52A to the nozzle through a valve 404. When the pump 32A is a positive displacement pump, the valve 404 can be a shut-off valve. Otherwise, the valve 404 can be, for example, a volumetric valve or variable orifice valve that provides more control over the amount of macro-ingredient 22 that is delivered to the nozzle 16.

In an optional embodiment, a recirculation line 406 is also provided. In some embodiment, the pump 32, heat exchanger 52, and the vacuum regulator 402 are eliminated. Some or all of the components shown in FIG. 4C can be positioned under the counter and/or in the back room.

Figure 4D:
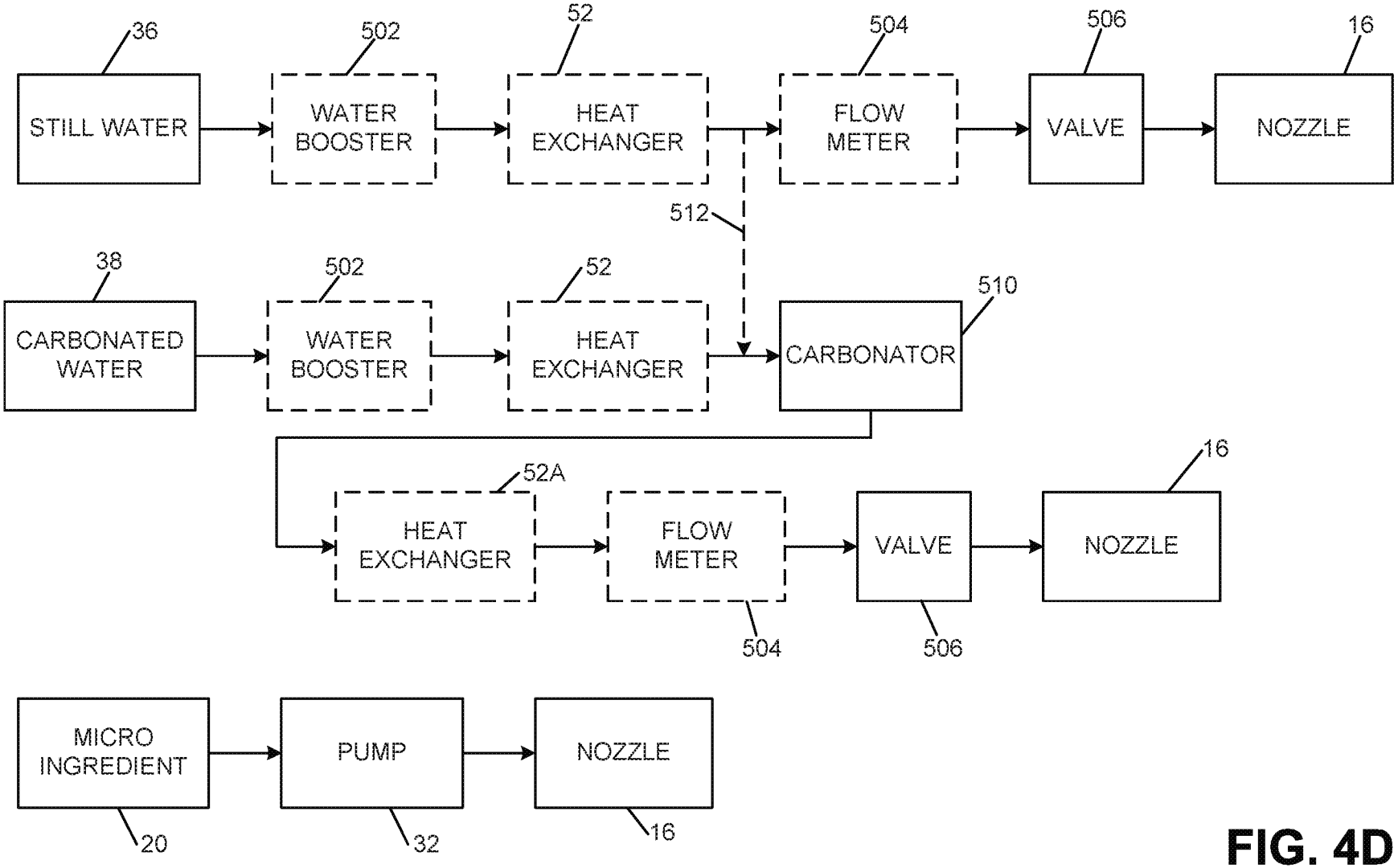
FIG. 4D illustrates a block diagram of another configuration of delivering still and carbonated water and micro-ingredients, in accordance with various embodiments disclosed herein

Referring now to FIG. 4D, an example configuration for delivery of the still and carbonated water and the micro-ingredient 20 from a backroom and/or under the counter to a nozzle for dispensing is shown.

The still water from the still water source 36 can be boosted by a water booster 502 that provides an additional source of water at a given pressure. This mixture flows through the heat exchanger 52 and is measured by an optional flow meter 504 as the still water is delivered to the nozzle 16. A valve 506, such as a volumetric valve or variable orifice valve controls the flow of the still water. In another embodiment, a shut-off valve in combination with a flow restrictor can be used.

The carbonated water from the carbonated water source 38 can be boosted by the water booster 502. Another heat exchanger 52 can be provided, or chilled water from a diverter line 512 can be provided from the still water source 36. The carbonated water flows through a carbonator 510 for carbonation. The carbonated water thereupon flows through another heat exchanger 52A (which can be the same heat exchanger 52), and through the flow meter 504 to the nozzle 16. The valve 506 again controls the flow of the carbonated water.

The micro-ingredient 20 is pumped by a pump 32, such as a positive displacement pump like a piston pump, etc. The micro-ingredient 20 is pumped to the nozzle 16.

Figure 5:
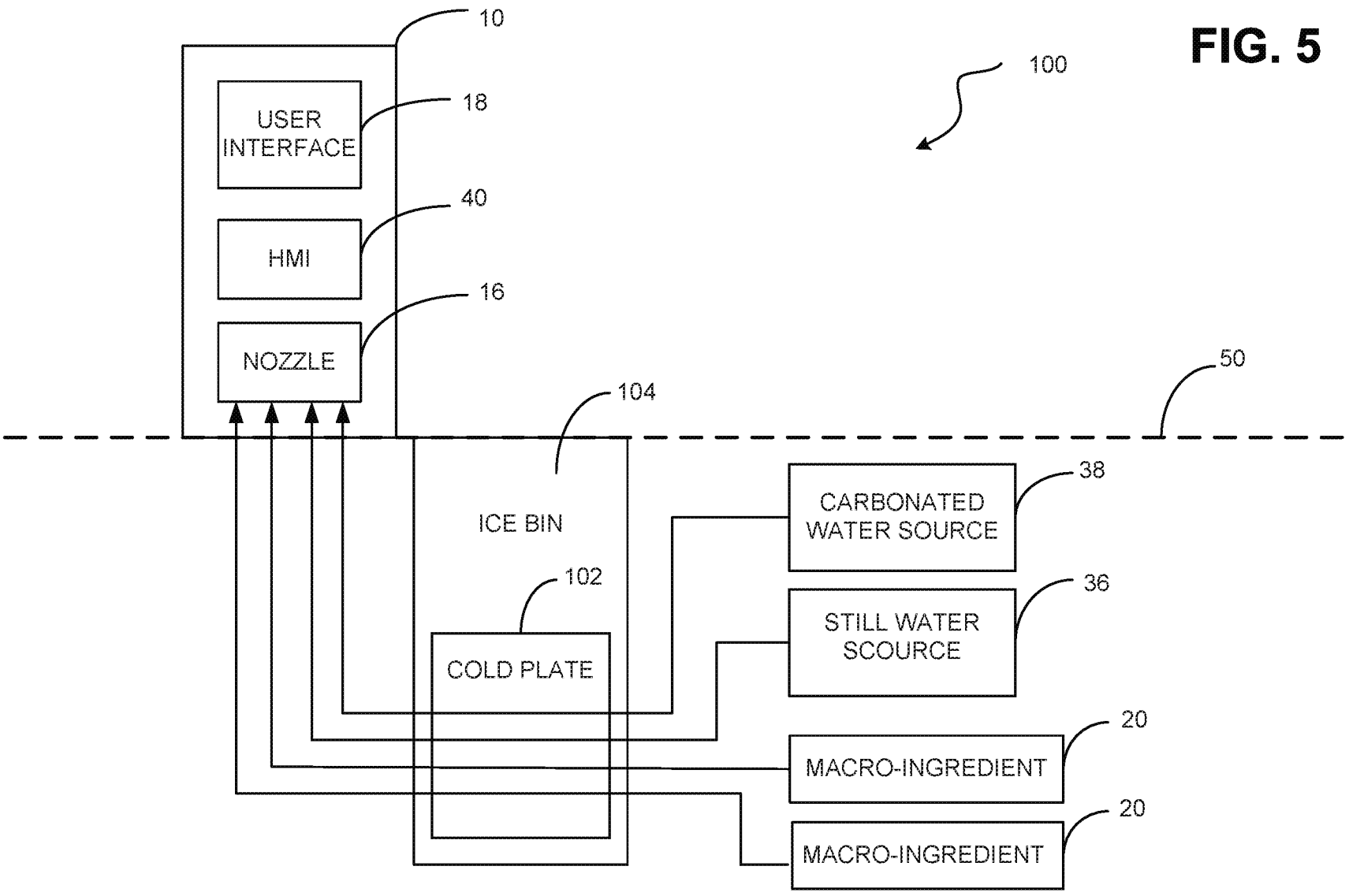
FIG. 5 illustrates one configuration of a drop-in beverage dispenser system having a cold plate within an ice bin wherein the cold plate exchanges heat with still water and carbonated water sources and macro-ingredients, in accordance with various embodiments disclosed herein.

FIG. 5 illustrates one configuration of a drop-in beverage dispenser system 100 having a cold plate 102 housed within an ice bin 104. Still water and carbonated water may be supplied from the still water source 36 and the carbonated water source 38 which may be in the back room 74. Alternatively, still water may be pumped from under the counter. The cold plate 102 exchanges heat with still water from the still water source 36, carbonated water from the carbonated water source 38, and the macro-ingredients 22 in contact with or passing through the cold plate 102. In another embodiment, the beverage dispenser system 100 may include a carbonator in thermal communication with the cold plate 102. Examples of such a carbonator in thermal communication with a cold plate is described in U.S. Patent Application Ser. No. 61/920,867, titled METHOD FOR MAINTAINING A COLD CARBONATOR USING A PORTION OF THE COLD PLATE, the entirety of which is hereby incorporated by reference.

Figure 6A:
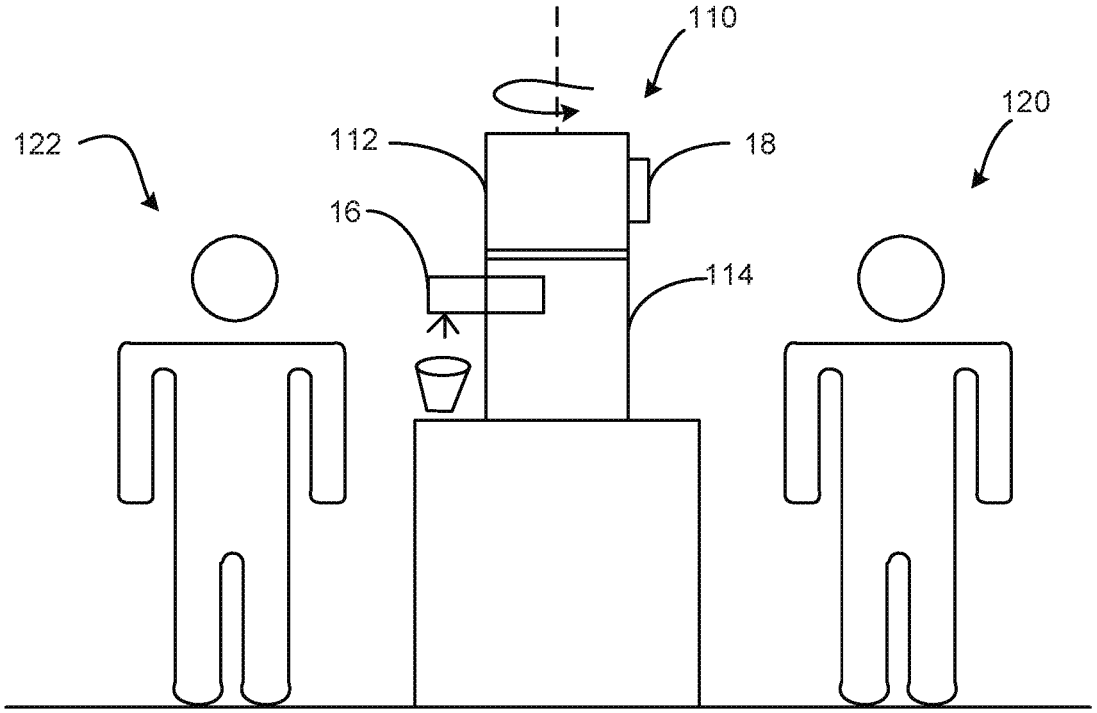
FIGS. 6A and 6B illustrate one configuration of a dispensing tower of a product dispenser system wherein an upper portion of the dispensing tower is rotatable such that a user interface may be utilized from either side of the dispensing tower, in accordance with various embodiments disclosed herein.
Figure 6B:
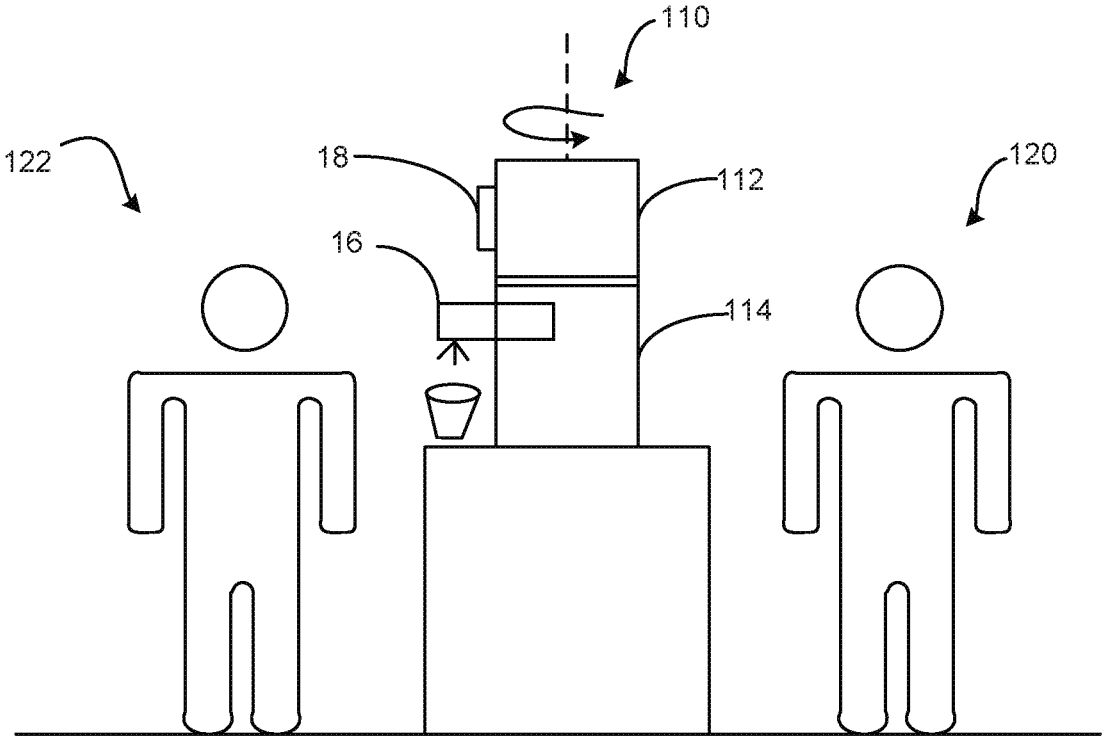

FIGS. 6A and 6B illustrate one configuration of a dispensing tower 110 with the nozzle 16 and user interface18. The dispensing tower 110 also includes an upper portion 112 and a lower portion 114. The user interface 18 is coupled to the upper portion 112 and the lower portion 114 includes the nozzle 16. The upper and lower portions 112, 114 are rotatably coupled together such that the upper portion 112 rotates at least partially relative to the lower portion 114. The upper portion 112 is rotatable relative to the lower portion 114 such that the user interface 18 may be utilized from either side of the dispensing tower 110. The lower portion 114 preferably remains stationary upon the counter.

In FIG. 6A the user interface 18 and the nozzle 16 are oriented on opposite sides of the dispensing tower 110. A consumer 120 faces the user interface 18 to request a beverage and a crew member 122 on the opposite side faces the nozzle 16. After the consumer requests a beverage on the user interface 18, the upper portion 112 of the dispensing tower 110 may be rotated to face the opposite direction so that the crew member 122 then faces the user interface 18 as shown in FIG. 6B. In FIG. 6B the user interface 18 and the nozzle 16 are oriented on the same side of the dispensing tower 110. The crew member 122 faces then interfaces with the user interface 18 to dispense the product for the consumer 120. Therefore, the consumer 120 faces the user interface 18 to request the product and the crew member 122 then faces the user interface 18 and the nozzle 16 to dispense the product from the nozzle 16.

FIG. 7 illustrates one configuration of a product dispensing system 130. The product dispensing system 130 is similar to the other product dispensing systems described above except that the product dispensing system 130 includes a detachable user interface 132 for making beverage selections. The detachable user interface 132 may be connected, for example, wirelessly (Wi-Fi), over Bluetooth or by physical connection using a cable to a dispensing tower 134 of the product dispensing system 130. The user interface 132 may be tethered to the dispensing tower 134 to allow sharing of an internet connection. An internet-connected user interface 132 can act as a portable wireless access point and router for dispensing tower 134 connected to it. The user interface 132 may be mounted to the counter adjacent to the dispensing tower 134.

FIG. 8 illustrates one configuration of a product dispensing system 140 having dispensing tower 142 utilizing a mobile computing device 144 to interface with the dispensing tower 142. The mobile computing device 144 may include, without limitation, a smartphone, a tablet personal computer, a laptop computer, biometric sensors and the like. A user may use a reader 146 on the mobile computing device 144 to scan a one or two-dimensional barcode (e.g., a QR code) or other symbol shown on a tag 148 or sticker affixed to, printed on the dispensing tower 142 or displayed on a display of the dispensing tower 142 to select a beverage for dispensing. The mobile computing device 144 may include a user interface 152 to facilitate the mobile computing device making a connection, such as wirelessly or cellular, to a server 154 which is also connected to the CDM 42 of the product dispensing system 140. Examples of facilitating interaction between a mobile computing device and an electronic device are described in U.S. Patent Publication No. 2015/0039776, entitled FACILITATING INDIVIDUALIZED USED INTERACTION WITH AN ELECTRONIC DEVICE, filed Jul. 31, 2013, the entirety of which is hereby incorporated by reference.

Figure 9:
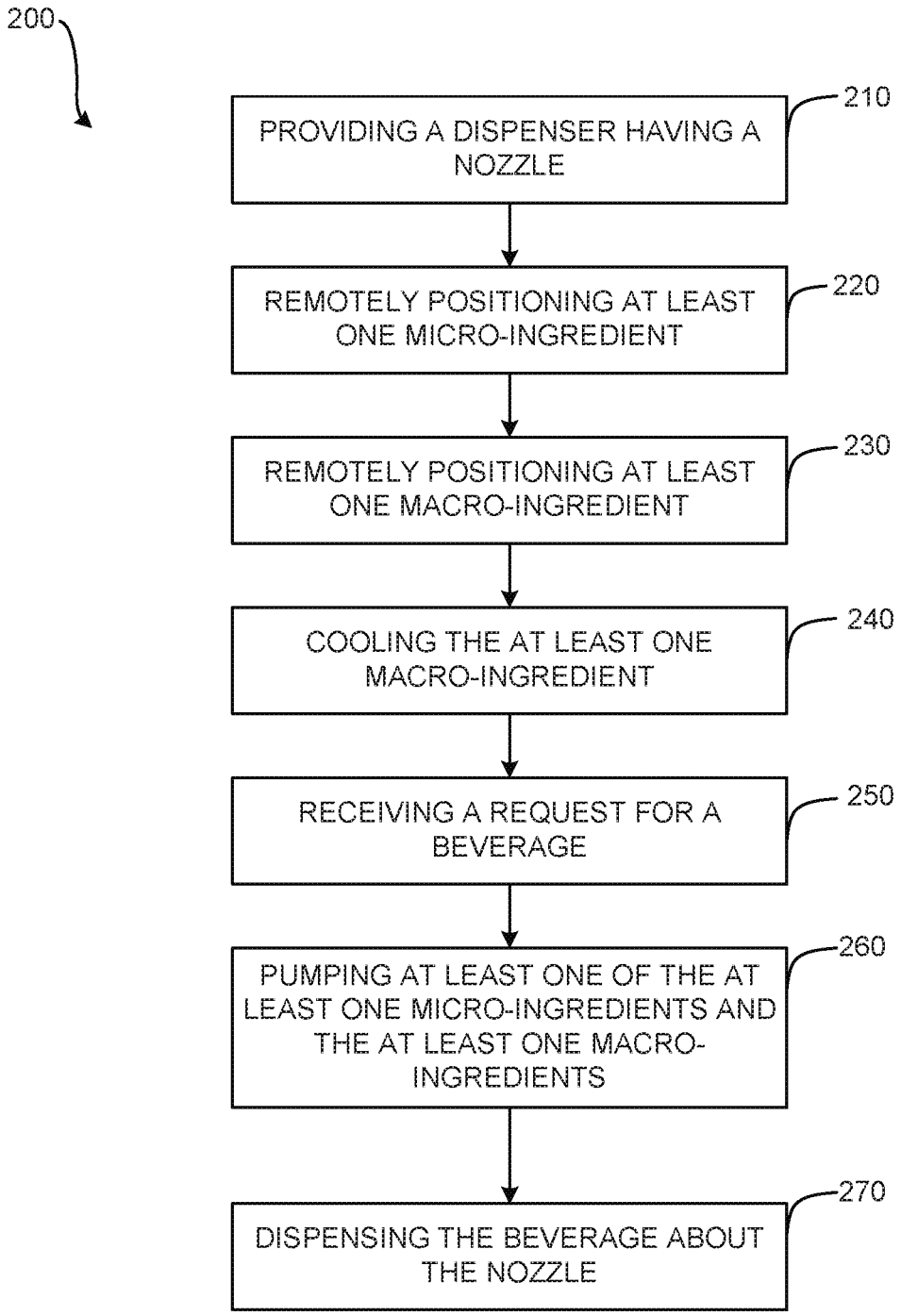
FIG. 9 illustrates a routine for dispensing a beverage, in accordance with various embodiments disclosed herein.

FIG. 9 illustrates a method 200 for method for dispensing a beverage. Unless otherwise indicated, more or fewer operations may be performed than shown in the figures and described herein. Additionally, unless otherwise indicated, these operations may also be performed in a different order than those described herein.

The method 200 starts at operation 210 with providing a dispenser having a nozzle 16. Operation 220 includes remotely positioning at least one micro-ingredient 20 and operation 230 includes remotely positioning at least one macro-ingredient 22. The method 200 also includes the operation 240 of cooling the at least one macro-ingredient 22. Operation 250 includes receiving a request for a beverage and operation 260 includes pumping at least one of the at least one micro-ingredient 20 and the at least one macro-ingredient 22 to the dispenser in response to receiving the request. Operation 270 includes dispensing the beverage about the nozzle 16.

The method 200 may also include the operation of positioning a heat exchanger 52 in a counter to cool the at least one macro-ingredient 22. Alternatively, the method may include the operation of positioning the heat exchanger 52 under the counter to cool the at least one macro-ingredient 22. Another alternative includes the operation of positioning the heat exchanger 52 in the dispenser to cool the at least one macro-ingredient 22. The method 200 may also include the operation of remotely positioning a carbonated water recirculator and recirculating carbonated water. Alternatively, the method 200 may include the operation of recirculating refrigerant and exchanging heat between cold refrigerant, still water and carbonated water to cool the still water and the carbonated water.

The subject matter described above is provided by way of illustration only and should not be construed as limiting. Various modifications and changes may be made to the subject matter described herein without following the example embodiments and applications illustrated and described, and without departing from the true spirit and scope of the present disclosure, which is set forth in the following claims.

What is claimed is:

1. A product dispensing system comprising:

a dispensing tower having a nozzle for dispensing a product, the dispensing tower positioned on a counter;

a micro-ingredient tower configured to receive a micro-ingredient package, the micro-ingredient tower positioned below the counter;

a micro-ingredient pump or metering device in communication with the micro-ingredient tower and adapted to dispense micro-ingredient from the micro-ingredient package to the nozzle, the micro-ingredient pump or metering device positioned below the counter;

a macro-ingredient pump adapted to dispense macro-ingredient from a macro-ingredient package to the nozzle, the macro-ingredient pump positioned below the counter;

a heat exchanger downstream from the macro-ingredient pump for cooling the macro-ingredient; and a core dispense module (CDM) adapted to control the micro-ingredient pump or metering device and further adapted to control the macro-ingredient pump, the CDM remotely positioned from the dispensing tower.

2. The product dispensing system of claim 1 wherein the macro-ingredient package is positioned in a back room.

3. The product dispensing system of claim 1 wherein the heat exchanger is positioned in the dispenser.

4. The product dispensing system of claim 1 further comprising a carbonated water source positioned remotely from the dispenser tower, the carbonated water source adapted to supply carbonated water to the nozzle.

5. The product dispensing system of claim 4 wherein the carbonated water source is positioned in a back room.

6. The product dispenser system of claim 5, wherein the carbonated water source is configured to recirculate carbonated water between the carbonated water source and the heat exchanger to define a recirculation loop.

7. The product dispenser system of claim 6 further comprising a still water source adapted to supply still water to the nozzle bundled with the recirculation loop.

8. The product dispensing system of claim 1 further comprising a human machine interface (HMI) module adapted to receive user inputs, the HMI module positioned in the dispensing tower and in communication with the CDM.

9. The product dispensing system of claim 8 further comprising a user interface adapted to be utilized to select the product, the user interface in communication with the HMI module.

10. The product dispensing system of claim 8 wherein the HMI module is configured to receive the user inputs from an external device.

11. The product dispenser system of claim 10 wherein the external device is configured for short range wireless communications via a wireless interface with the dispensing tower.

* * * * *